United States Patent [19]

Fuller, Sr.

[11] Patent Number: 5,058,884

[45] Date of Patent: Oct. 22, 1991

[54] EXERCISE MACHINE FOR CONDITIONING FOOTBALL PLAYERS

[76] Inventor: Barney R. Fuller, Sr., 15605 Singapore La., Houston, Tex. 77040

[21] Appl. No.: 503,460

[22] Filed: Mar. 29, 1990

[51] Int. Cl.[5] ..... A63B 21/06

[52] U.S. Cl. ..... 272/117; 272/134; 273/55 R

[58] Field of Search ..... 272/116, 117, 118, 123, 272/134, 143; 273/55 R, 55 A

[56] References Cited

U.S. PATENT DOCUMENTS

| | | | |
|---|---|---|---|
| 3,573,865 | 4/1971 | Annas | 272/117 |
| 4,344,619 | 8/1982 | Szabo | 272/117 |
| 4,357,010 | 11/1982 | Telle | 272/117 |
| 4,511,137 | 4/1985 | Jones | 272/118 |
| 4,621,810 | 11/1986 | Cummins | 272/134 |
| 4,627,614 | 12/1986 | De Angeli | 272/117 |
| 4,722,522 | 2/1988 | Lundoren | 272/117 |
| 4,917,379 | 4/1990 | Maag | 272/134 |
| 4,923,195 | 5/1990 | Calderone | 272/117 |

FOREIGN PATENT DOCUMENTS

| | | | |
|---|---|---|---|
| 3327235 | 2/1985 | Fed. Rep. of Germany | 272/117 |

*Primary Examiner*—Robert Bahr
*Attorney, Agent, or Firm*—Kenneth A. Roddy

[57] ABSTRACT

An exercise machine has a frame with a generally rectangular base and a platform at the rearward end of the base upon which the athlete stands. A horizontal shaft rotatably mounted on a pair of vertical frame members near the forward end of the base has a central sprocket at its center and smaller sprockets at its outer ends. A weight supporting member pivotally connected to a pair of upright frame members extends forwardly therefrom and a selected number of weights are received on the outer end of the weight supporting member. A pivot arm pivotally connected to the upright members extends forwardly therefrom and has an elongate lift arm secured thereto which extends angularly upward and rearward therefrom toward the platform. A hand grip bar at the outer end of the lift arm is positioned a selective distance above the platform has two sets of hand grips for griping the bar in two positions. A first chain wrapped around the central sprocket has its free end connected to the pivot arm and a pair of second chains each wrapped around an outer sprocket in the opposite direction have their free ends connected to the weight supporting member. When the lift arm is raised by an upward force on the hand grip bar, the pivot arm pivots downward pulling the first chain down causing rotation of the central sprocket and outer sprockets which causes the second chains to pivot the weight supporting member upward with the weights at the outer ends thereof resisting the upward force applied to the hand grip bar.

12 Claims, 2 Drawing Sheets

EXERCISE MACHINE FOR CONDITIONING FOOTBALL PLAYERS

BACKGROUND OF THE INVENTION

1. Field of the Invention

This invention relates generally to the field of sports conditioning exercise machines, and more particularly to an exercise machine for conditioning football players to pivot the upper body relative to the lower body by forcefully moving the hips in a roll and drive motion upwardly through a resistive weight load to accomplish the most effective and powerful offensive or defensive blocking movement.

1. Brief Description of the Prior Art

In the sport of football, the most effective way to block an opposing player is to advance toward the opponent while moving horizontally in a crouched position, and upon making contact with the opponent, to exert an explosive force vertically upward on the opponent which tends to lift the opponent off the ground. The player doing the blocking must smoothly and quickly pivot the upper body relative to the lower body by forcefully moving his hips in a roll and drive motion upwardly through the weight load to accomplish the most effective and powerful blocking movement. This explosive movement employs the leg, hip, abdominal, back, arms, shoulder, and chest muscles in one explosive movement.

A strong athlete is not necessarily a powerful athlete and strength alone will not acheive the best results on the field of play. In blocking actions, the explosive movement requires the athlete to lift a heavy resistive weight over a full range of upward movement at a high rate of speed. While an athlete may acquire strength from lifting weights, powerful blocking technique requires performing multiple sets of reptitions of the desired movement at a predetermined weight load within a predetermined number of seconds.

While there are many devices which teach the art of blocking, none of these devices promotes the mastery of, or conditions the muscles in the manner utilized in the explosive hip roll and drive motions described above. Most of the conventional blocking devices merely train a player to charge towards an object, and provide some resistance to the force exerted by the charging player.

There are several patents which disclose various exercise machines for conditioning and strengthening athletes and other apparatus particularly designed for training football players.

Brentham, U.S. Pat. No. 3,822,599 discloses an exercise device comprising a handle pivotally mounted on a frame with a hydraulic system connected to the handle to exert a regulated force restraining movement of the handle.

Teile, U.S. Pat. No. 4,357,010 discloses an exercise apparatus for developing selected muscles of the body comprising a rigid upright support having a first beam pivoted on a horizontal axis near the top of the support and a second beam similarly pivoted below the first beam. The two beams are connected by a telescopic link to move together. Handles and shoulder pads are provided for lifting the first beam and a weight holding rod on the outer end of the second beam receives a selected number of weights to be lifted. The rate of movement of the beams is maintained substantially constant by a hydraulic cylinder.

Palladino, Jr., U.S. Pat. No. 4,720,103 discloses a training device for football players to train the user in the art of blocking. The apparatus includes a frame which defines an upwardly-sloping track, and a carriage which moves along the track. The carriage is connected by a pulley system to a hydraulic or pneumatic cylinder or the equivalent for imparting resistance to the movement of the carriage along the track.

Lundgren, U.S. Pat. No. 4,722,522 discloses an exercise machine comprising an operating bar which can be moved between operating positions at least 180 degrees apart, and a sprocket on the axis of motion carries a chain connected to a lever for exerting a near constant reaction force or torque. A bellcrank on the same axis carries weights that provide a variable force or torque on the movable bar. The user assumes one position to exercise the biceps and another position to exercise the triceps.

The present invention is distinguished over the prior art in general, and these patents in particular by an exercise machine having a frame with a generally rectangular base. The athlete stands on a platform at the rearward end of the base. A horizontal shaft rotatably mounted on a pair of vertical frame members near the forward end of the base has a central sprocket at its center and smaller sprockets at its outer ends. A weight supporting member pivotally connected to a pair of upright frame members extends forwardly therefrom and a selected number of weights are received on the outer end of the weight supporting member. A pivot arm pivotally connected to the upright members extends forwardly therefrom and has an elongate lift arm secured thereto which extends angularly upward and rearward therefrom toward the platform. A hand grip bar at the outer end of the lift arm is positioned a selective distance above the platform has two sets of hand grips for griping the bar in two positions. A first chain wrapped around the central sprocket has its free end connected to the pivot arm and a pair of second chains each wrapped around an outer sprocket in the opposite direction have their free ends connected to the weight supporting member. When the lift arm is raised by an upward force on the hand grip bar, the pivot arm pivots downward pulling the first chain down causing rotation of the central sprocket and outer sprockets which causes the second chains to pivot the weight supporting member upward with the weights at the outer ends thereof resisting the upward force applied to the hand grip bar.

The present exercise machine is particularly useful in developing the ability of an offensive or defensive lineman to smoothly and quickly pivot the upper body relative to the lower body by forcefully moving his hips in a roll and drive motion upwardly through a resistive weight load to accomplish the most effective and powerful blocking movement. The present invention conditions and strengthens the specific muscle groups employed in this explosive movement. The invention can also be used simply as an exercise machine, even by persons who are not trying to improve their blocking skills.

SUMMARY OF THE INVENTION

It is therefore an object of the present invention to provide a exercise machine which aids a football player in perfecting the art of blocking.

It is another object of this invention to provide an exercise machine which strengthens and conditions the specific muscle groups used in an effective blocking motion.

Another object of this invention is to provide an exercise machine which conditions a football player to smoothly and quickly pivot the upper body relative to the lower body by forcefully moving his hips in an explosive roll and drive motion upwardly through the weight load so as to lift his opponent off the ground.

Another object of this invention is to provide an exercise machine which teaches a football player to block an opponent, wherein the resistive weight load can be varied.

A further object of this invention is to provide an exercise machine which strengthens and conditions the leg, hip, abdominal, back, arms, shoulder, and chest muscles in one explosive movement.

A still further object of this invention is to provide an exercise machine which is simple in construction, economical to manufacture, and rugged and reliable in use.

Other objects of the invention will become apparent from time to time throughout the specification and claims as hereinafter related.

The above noted objects and other objects of the invention are accomplished by the present exercise machine which specifically develops the ability of an offensive or defensive lineman to smoothly and quickly pivot the upper body relative to the lower body by forcefully moving his hips in a roll and drive motion upwardly through a resistive weight load to accomplish the most effective and powerful blocking movement. The present invention conditions and strengthens the specific muscle groups employed in this explosive movement. The invention can also be used simply as an exercise machine, even by persons who are not trying to improve their blocking skills.

DESCRIPTION OF THE PREFERRED EMBODIMENT

Figure 1:
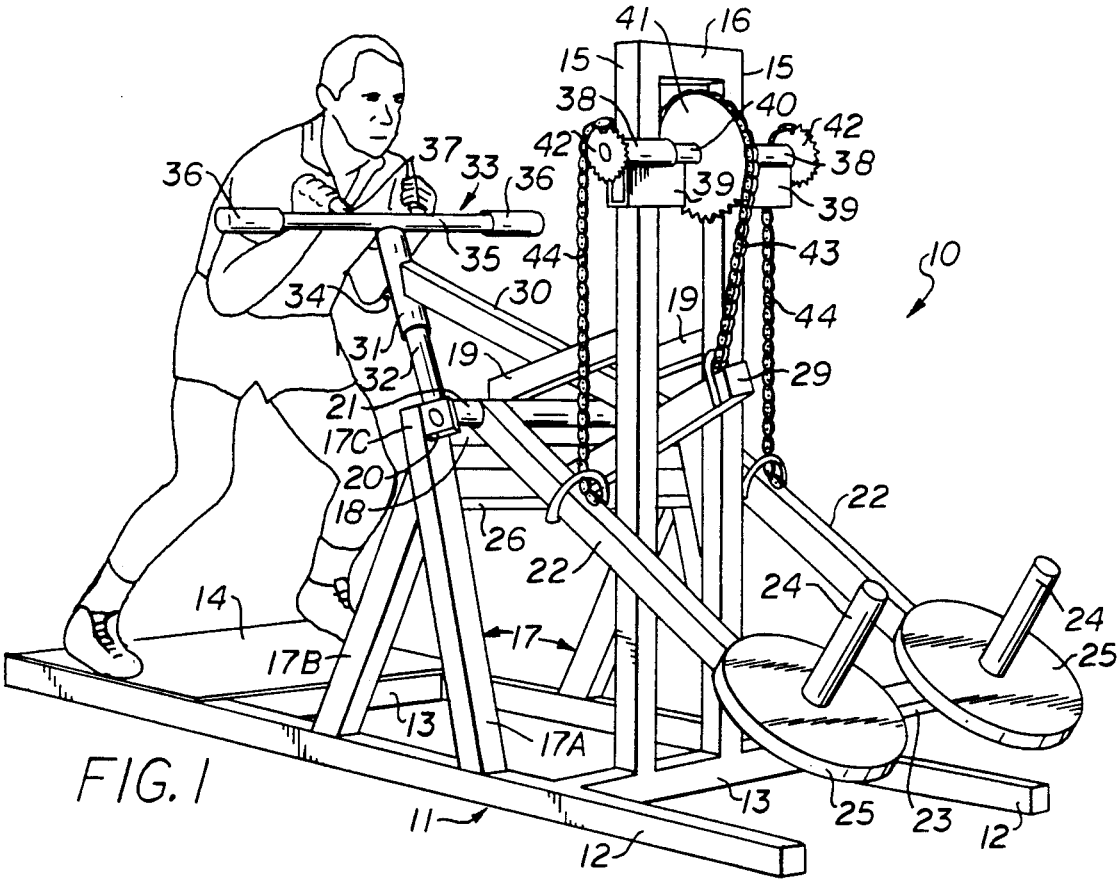
FIG. 1 is a perspective view showing a person using an exercise machine in accordance with the present invention at the beginning of a defensive blocking movement with the hands placed close together on the hand grip bar.
Figure 2:
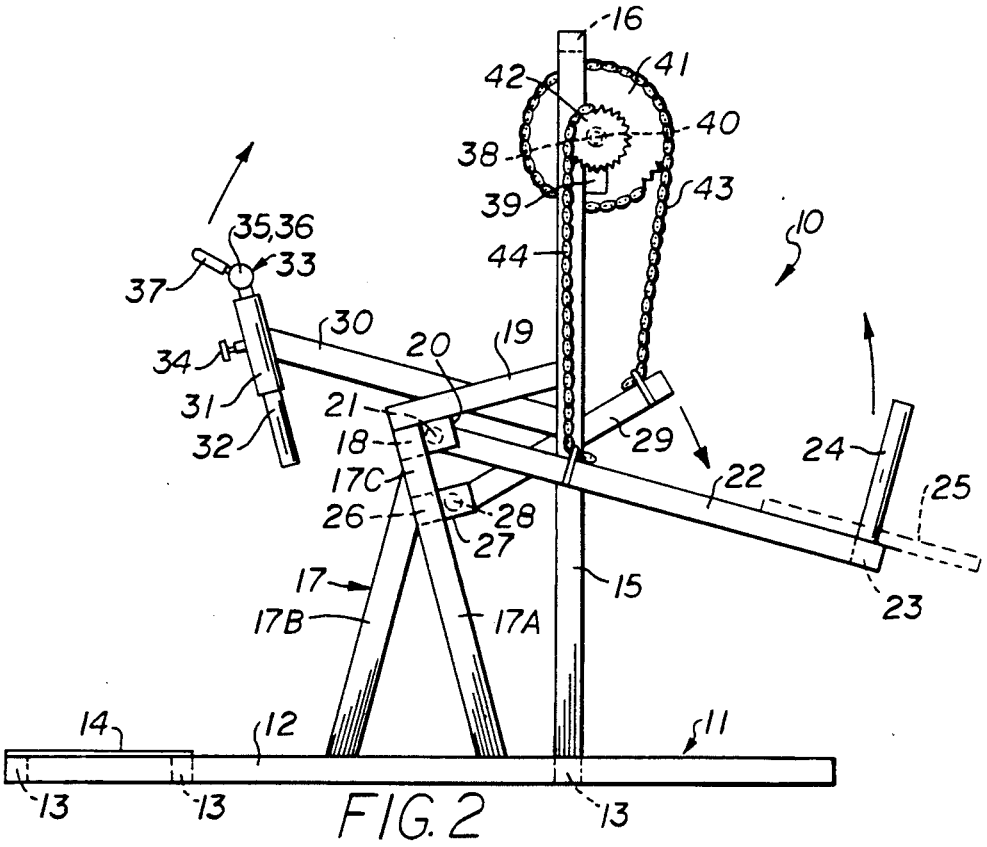
FIG. 2 is a side elevation of the exercise machine of FIG. 1.
Figure 3:
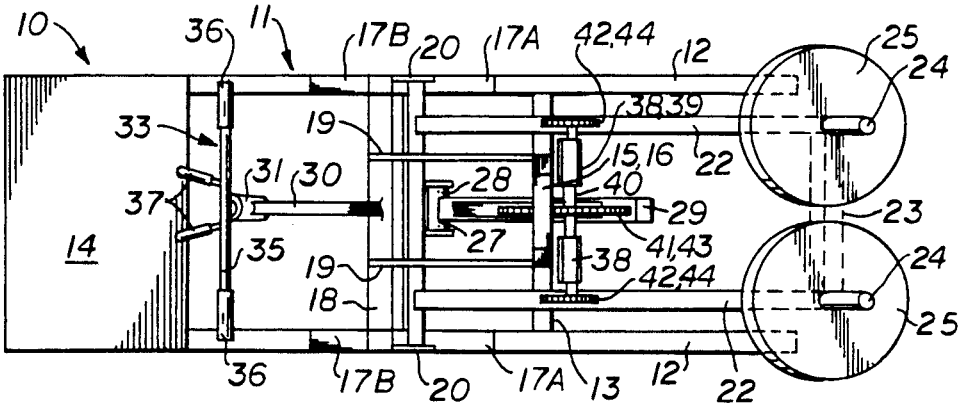
FIG. 3 is a top plan view of the exercise machine of FIG. 1.
Figure 4:
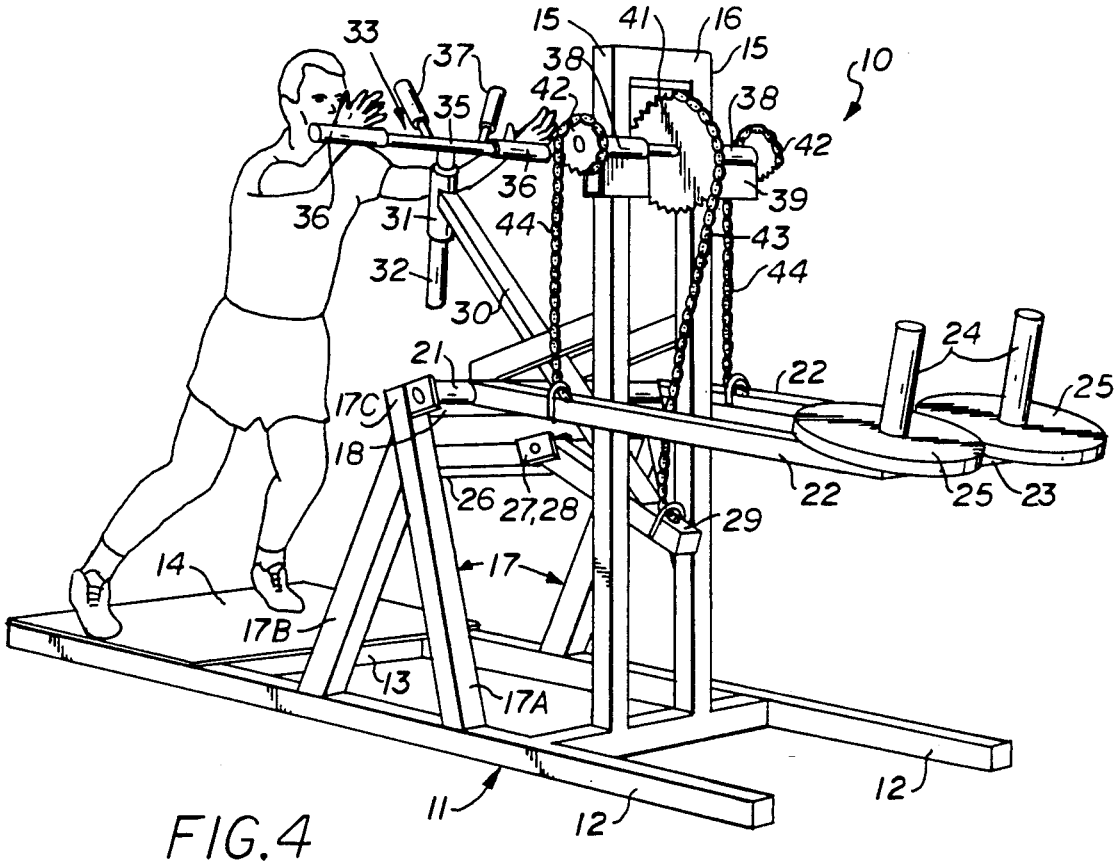
FIG. 4 is a perspective view showing a person using the exercise machine at the end of an offensive blocking movement with the hands gripping the hand grip bar in a wide position.

Referring to the drawings by numerals of reference, there is shown in FIGS. 1, 2, and 3, a preferred exercise machine 10 which develops the ability of an offensive or defensive lineman to smoothly and quickly pivot the upper body relative to the lower body by forcefully moving his hips in a roll and drive motion upwardly through a resistive weight load to accomplish the most effective and powerful blocking movement.

The exercise machine 10 comprises a frame 11 having a pair of elongate parallel spaced base members 12 of square tubing. One or more cross members 13 are secured transversly between the base members 12 at longitudinally spaced locations. A foot platform 14 of flat plate is secured to the top of the base member 12 at one end to extend transversly between the base members to provide a surface upon which the athlete stands.

A pair of parallel spaced vertical members 15 of square tubing are secured at their bottom ends to a cross member 13 near the end opposite the foot platform 14. The vertical members 15 are spaced laterally inward relative to the base members 12. A horizontal upper cross member 16 is secured transversly between the vertical members 15 at their top ends.

A pair of inverted V-shaped upright members 17 of square tubing are secured at their bottom ends one to each to base member 12 in laterally opposed relation to converge upwardly therefrom. One leg 17A of each the upright member 17 is longer than the other leg 17B to form an extension 17C. An upper cross member 18 of square tubing is secured transversly between the extensions 17C of the upright members 17. A pair of braces 19 are secured between the cross member 18 and each vertical member 15. A pair of rectangular straps or brackets 20 are secured at the upper ends of the extensions 17C and extend outwardly therefrom. A round bar 21 is rotatably mounted between the brackets 20.

A pair of elongate weight arms 22 of square tubing are secured to the round bar 21 and extend angularly outward a downward therefrom just outside the vertical members 15. A cross member 23 is secured transversly between the weight arms 22 at their outer ends. A round bar 24 secured to the the top surface of the outer ends of each weight arm extends upwardly therefrom to receive weights 25. The weight arms 22 are pivotally raised and lowered about the axis of the round bar 21 as it rotates as explained hereinafter.

A lower cross member 26 is secured between the legs 17A beneath and parallel to the upper cross member 18. As best seen in FIG. 3, a pair of parallel spaced rectangular straps or brackets 27 are secured near the center of the lower cross member 26 and extend outwardly therefrom. A round bar 28 is rotatably mounted between the brackets 27. A pivot arm 29 of square tubing is secured to the round bar 28 and extends angularly outward and upward therefrom between the vertical members 15.

An elongate lift arm 30 of square tubing is secured to the pivot arm 29 intermediate its ends and extends angularly upward and outward therefrom toward the foot platform end (14). A hollow tubular member 31 is secured to the outer end of the lift arm 30 and slidably receives the depending leg 32 of a generally T-shaped hand grip bar 33. A lock screw 34 threadedly mounted through the side wall of the tubular member 31 engages the leg 32 to secure the horizontal member 35 of the T-shaped hand grip bar 33 at the desired height. Padded outer hand grips 36 are provided on the outer ends of the horizontal member 35 and a pair of upwardly and outwardly diverging inner hand grips 37 are provided near the center of the horizontal member 35. Thus, the hand grip bar 33 may be gripped in two positions as explained hereinafter.

A pair of hollow tubular members 38 are secured in horizontal axial alignment one to each vertical member 15 near their upper ends, and a pair of square tubular members 39 are secured to the vertical members 15 and to the horizontal tubular members 38 for support.

A shaft 40 is rotatably mounted through the hollow tubular members 38 and extends outwardly to each side thereof. A sprocket 41 is mounted at the center of the shaft 40 and a pair of smaller sprockets 42 are mounted one on each outer end of the shaft.

A chain 43 is wrapped around at least a segment of the larger sprocket 41 and has a free end connected to the pivot arm 29. A chain 44 is wrapped around at least a portion of each smaller sprocket 42 and each chain has a free end connected to one of the weight arms 22. The chains 43 and 44 are wrapped in opposite directions around the sprockets 41 and 42 respectively.

When the lift arm 30 is raised by an upward force on the hand grip bar 33, the pivot arm 29 will rotate about the axis of the round bar 28 to pivot downward pulling the end of the chain down and rotating the larger sprocket 41. Rotation of the sprocket 41 rotates the shaft 40 and the smaller sprockets 42 at its ends causing the ends of chains 44 to pull upward on the weight arms 22 pivoting it upward about the axis of the round bar 21. Resistance to the upward force applied to the hand grip bar 33 and lift arm 30 is determined by the weights 25 installed on the round bars 24 at the outer ends of the weight arms 22.

OPERATION

To use the exercise machine 10, the height of the hand grip bar 33 is secured at the proper distance above the platform 14 and the proper number of weights 25 are placed on the rods 24. The athlete stands on the platform 14 and lowers his hips to assume a crouched position (FIG. 1) and grasps either the inner hand grips 37 or the outer hand grips 36. The inner grips 37 are used for a defensive blocking movement and the outer grips 36 are used for an offensive blocking movement.

The movement is initiated with the hips. In one smooth movement, the hips are forcefully and quickly rolled forward bringing the upper body upward against the weight load and finishing the movement with a full extension of the arms which raises the hand grip bar against the resistive weight load. In this movement, the lower body and particularly the hips initially activate the weight load and the upper body finishes out the explosive lifting of the weight load. This motion involves all the major muscle groups in the body. All the muscles of the legs, hips, lower back, lower abdominal, upper abdominal, chest, upper back, shoulders, and arms are activated together through one simultaneous explosive movement. This manuever conditions the athlete to explode the hips into the weight load.

When the lift arm 30 is raised by the upward force on the hand grip bar 33, the pivot arm 29 will rotate about the axis of the round bar 28 to pivot downward pulling the end of the chain 43 down and rotating the larger sprocket 41. Rotation of the sprocket 41 rotates the shaft 40 and the smaller sprockets 42 at its ends causing the ends of chains 44 to pull upward on the weight arms 22 pivoting it upward about the axis of the round bar 21. Resistance to the upward force applied to the hand grip bar 33 and lift arm 30 is determined by the weights 25 installed on the round bars 24 at the outer ends of the weight arms 22. At the end of the movement the weight arms 22 and the pivot arm 29 are nearly perpendicular to the vertical members 15.

A set of eight to twelve repetitions is recommended and should be accomplished in approximately fifteen seconds. Different muscle fibers are affected by a quick movement than by a slow movement. Moving through the explosive manuever rapidly develops and conditions the white, or "fast twitch" muscle fibers. Red, or "slow twitch" muscle fibers are used in slow movements such as in simple weight lifting exercises. Power developed by quickness in overcoming an increasing weight load. In other words, if it takes one person a minute to move weight a certain distance and another person can do it in three seconds, he is said to have more power.

Power, rather than strength alone, is what will acheive the best results on the field of play. In blocking actions, the explosive movement requires the athlete to lift a heavy resistive weight over a full range of upward movement at a high rate of speed. While an athlete may acquire strength from lifting weights, powerful blocking technique requires performing multiple sets of repetitions of the desired movement at a predetermined weight load within a predetermined number of seconds. The present exercise machine will condition an athlete to be quick, powerful, and explosive.

While this invention has been described fully and completely with special emphasis upon a preferred embodiment, it should be understood that within the scope of the appended claims the invention may be practiced otherwise than as specifically described herein.

I claim:

1. An exercise machine for conditioning athletes comprising;

a frame having a generally rectangular base portion for supporting the frame on a flat surface and having forward and rearward ends, a foot platform at the rearward end of the base portion upon which the athlete stands, a pair of parallel laterally spaced vertical members near the forward end of said base portion, and a pair of laterally spaced upright members on said base portion between the foot platform and the vertical members, a weight lever pivotally mounted at one end to said upright members on a horizontal axis and extending forwardly therefrom and having weight receiving means at its outer end for receiving a selected number of weights to be lifted, a pivot arm pivotally connected at one end to said upright members on a horizontal axis and extending forwardly between said vertical members and having an elongate lift arm secured thereto intermediate its ends which extends angularly upward and rearward between said vertical members toward said foot platform, rotating means rotatably mounted at the upper end of said vertical members and extending horizontally thereacross including first connecting means having a first end connected to said rotating means and a second end connected to said pivot arm near its outer end and a pair of second connecting means each having a first end connected to said rotating means at each side of said first connecting means and a second end connected to said weight lever, said first ends of said first and said second connecting means connected to said rotating means to rotate therewith in opposite directions respectively about the horizontal axis of said rotating means, and a horizontal hand grip bar adjustably mounted at the outer end of said lift arm and positionable a selective distance above and parallel to said platform and having hand grips thereon, said lift arm when raised by an upward force on said hand grip bar causes said pivot arm to pivot downward pulling said first connecting means downward causing rotation of said rotating means and simultaneously causing said second connecting means to pull upward on said weight lever to pivot it upward with the weights at the outer ends thereof resisting the upward force applied to said hand grip bar.

2. An exercise machine according to claim 1 in which said horizontal hand grip bar is adjustably mounted at the outer end of said lift arm to be positioned a selective distance above and parallel to said foot platform, and said hand grip means comprises a pair of outer hand grips at each outer end and a pair of upwardly and outwardly diverging inner hand grips near its center allowing the hand grip bar to be gripped in two different positions, whereby an athlete standing on said platform may grip said inner hand grips and assume a crouched position to simulate the blocking stance of a defensive lineman, or may grip said outer hand grips while in the crouched position to simulate the blocking stance of an offensive lineman, and said hand grip bar is raised by the athlete quickly rolling his or her hips forward and bringing the upper body upward against the resistive weight load and finishing the movement with a full extension of the arms.

3. An exercise machine according to claim 2 in which said hand grip bar comprises a generally T-shaped bar member having a horizontal portion and a vertical leg, said lift arm has a collar secured at its outer end with locking means thereon, and said hand grip bar vertical leg is slidably received within said collar and secured therein by said locking means at selective positions for adjustably positioning said horizontal portion a distance above said foot platform to accomodate athletes of various size.

4. An exercise machine according to claim 1 in which said rotating means comprises a horizontal shaft rotatably mounted at the upper end of said vertical members and extending outwardly to each side thereof, central sprocket secured at the center of said shaft and a pair of second sprockets secured one on each outer end of said shaft, and said connecting means comprises a first chain wrapped around at least a segment of said central sprocket and its free end connected to said pivot arm, a pair of second chains each wrapped around at least a portion of each said second sprocket and the free end of each connected to one of said weight support member arms, said first chain and said second chains being wrapped in opposite directions around said central and said second sprockets respectively, whereby when said lift arm is raised by an upward force on said hand grip bar, said pivot arm will pivot downward pulling said first chain down causing rotation of said central sprocket and said horizontal shaft and said second sprockets at its outer ends which simultaneously cause said second chains to pull upward on said weight arms to pivot it upward with the weights at the outer ends thereof resisting the upward force applied to said hand grip bar.

5. An exercise machine according to claim 1 in which said weight lever comprises a weight supporting member having a pair of elongate laterally spaced arms pivotally mounted at one end to said upright members on a horizontal axis to extend forwardly therefrom at each side of said vertical members.

6. An exercise machine according to claim 1 in which said frame base portion comprises a pair of elongate parallel spaced tubular base members with longitudinally spaced cross members secured transversly therebetween, and said foot platform is a flat plate secured to the top of said base members at one end to extend transversly therebetween.

7. An exercise machine according to claim 6 in which said vertical members comprise a pair of parallel spaced vertical tubular members secured at their bottom ends to a said cross member near the end opposite said foot platform and positioned laterally inward relative to said base members and joined at their upper ends by a horizontal cross member secured transversly therebetween.

8. An exercise machine according to claim 6 in which said upright members are secured at their bottom ends one to each said base member in laterally opposed relation to extend upwardly therefrom and positioned between said foot platform and said vertical members and joined at their upper ends by a horizontal upper cross member secured transversly therebetween and having a lower cross member secured transversly between said upright members beneath and parallel to the upper cross member.

9. An exercise machine according to claim 8 in which said upright members comprise a pair of inverted V-shaped tubular members secured at their bottom ends one to each base member to converge upwardly therefrom, and said horizontal upper cross member is secured transversely between the upper ends thereof.

10. An exercise machine according to claim 8 in which said weight lever comprises a pair of parallel elongate tubular weight arms each pivotally mounted at one end to the horizontal upper cross member of said upright member and extending forwardly therefrom at each side of said vertical members and joined at their outer ends by a cross member secured transversly therebetween and having an upright round bar secured to the the top surface of the outer ends of each said weight arm to receive said weights to be lifted.

11. An exercise machine according to claim 8 in which said pivot arm comprises a tubular member pivotally connected at one end to the lower cross member of said upright member and extending forwardly therefrom between said vertical members and said lift arm comprises an elongate tubular member secured thereto which extends angularly upward and rearwardly therefrom between said vertical members toward said foot platform.

12. An exercise machine according to claim 8 including a pair of laterally spaced brace members each secured at one end to the horizontal upper cross member of said upright members and at their other end to one of said vertical members.

* * * * *